United States Patent [19]

Larsson

[11] Patent Number: 4,958,866

[45] Date of Patent: Sep. 25, 1990

[54] DOORLEAF LOCK

[75] Inventor: Ingmar Larsson, Askim, Sweden

[73] Assignee: Fixfabriken AB, Goteborg, Sweden

[21] Appl. No.: 325,953

[22] Filed: Mar. 20, 1989

[30] Foreign Application Priority Data

Mar. 21, 1988 [SE] Sweden ..... 8801014-5

[51] Int. Cl.[5] ..... E05B 15/00

[52] U.S. Cl. ..... 292/245; 292/153

[58] Field of Search ..... 292/153, 216, 244, 245; 70/416

[56] References Cited

U.S. PATENT DOCUMENTS

| | | | |
|---|---|---|---|
| 113,909 | 4/1871 | Munger | 292/244 |
| 161,700 | 4/1875 | Munger | 292/244 |
| 166,129 | 7/1875 | Moore | 292/244 |
| 172,880 | 2/1876 | Jennings | 292/244 |
| 186,556 | 1/1877 | Griscom et al. | 292/244 |
| 198,704 | 12/1877 | Sparks | 292/244 |
| 405,241 | 6/1889 | Austin | 292/244 |
| 3,811,717 | 5/1974 | Floyd et al. | 292/153 X |
| 4,667,990 | 5/1987 | Quantz | 292/216 X |

FOREIGN PATENT DOCUMENTS

| | | | |
|---|---|---|---|
| 2031370 | 12/1971 | Fed. Rep. of Germany . | |
| 48498 | 12/1939 | Netherlands | 292/244 |
| 1175959 | 1/1970 | United Kingdom . | |

*Primary Examiner*—Gary L. Smith
*Assistant Examiner*—Michael Milano
*Attorney, Agent, or Firm*—Hill, Van Santen, Steadman & Simpson

[57] ABSTRACT

A doorleaf lock, comprising a lock mechanism for controlling a locking bolt (12) and a catch bolt (15), which is controlled by means of a door handle. The catch bolt, in a neutral position defined by a spring means (21), extends with a non-circular bolt head (17) through a non-circular opening (16) in the lock front wall (11). The catch bolt is displaceable into the lock, against the action of the spring means (21), during manipulation of the handle. The catch bolt (15) abuts a catch means (22) in said neutral position, said catch means being accessible via a second opening (28) in the front wall (11). The catch means is displaceable from its catch position by manipulation from the outside via the second opening (28). Further, after said manipulation of the catch means (22), the catch bolt is displaceable with its bolt head (17) out of the non-circular opening (16) to the outside of the lock, enabling a turning of the catch bolt around its longitudinal axis.

1 Claim, 3 Drawing Sheets

DOORLEAF LOCK

FIELD OF THE INVENTION

The present invention relates to a doorleaf lock, having a lock mechanism for governing a locking bolt and a catch bolt which is controlled by means of a door handle, wherein said catch bolt, in a neutral position defined by a spring means, extends with a non-circular bolt head through a non-circular opening in the lock front wall, and which is displaceable into the lock, against the action of the spring means, during manipulation of said handle.

BACKGROUND OF THE INVENTION

Catch bolts are provided with a surface which is parallel to the longitudinal axis of the bolt and a bevelled surface on the opposite side, which enables closing of the door without manipulation of the door handle. Traditionally, door locks have been manufactured in two versions, for left and right side hinged doors. However, one has realized the advantage of manufacturing a single lock which may be used both for left and right side hinged doors, which means that the catch bolt must be able to turn 180°.

One known lock design with a reversible catch bolt is so designed that one part of the lock has to be dismounted in order to enable turning. Thus, it is not possible to turn the catch bolt while the lock is mounted in door leaf. A further disadvantage with this design, is that the dismounted parts, e.g. screws and screw nuts may be lost.

Another known lock design with a reversible catch bolt is so designed, that the catch bolt may be turned without dismounting the lock from the door leaf. This is possible because the catch bolt is divided, so that the catch bolt head is displaceably journalled at a bolt shaft and may be pulled out of the lock, against the action of a spring. This design has one drawback in that further spring means are required. Besides, the division of the catch bolt in two parts results in a weakening of a part which is exposed to side forces and wear.

SUMMARY OF THE INVENTION

One object of this invention is to provide a lock with a rotatable catch bolt, which does not have the above described drawbacks.

According to the invention, the catch bolt abuts a catch means in said neutral position, said catch means being accessible via a second opening in the front wall, that the catch means is displaceable from its catch position by manipulation from the outside via the second opening so that the catch bolt after said manipulation of the catch means can be displaced with its bolt head out of the non-circular opening to the outside of the lock, enabling a turning of the catch bolt around its longitudinal axis.

According to a preferred embodiment of the invention, the catch means is pivotable around a pivot axis, which extends across the longitudinal axes of the bolts and the plane of the lock housing. A secure guiding of the catch means is accomplished by this method of bearing.

Preferably, the pivot axis is placed adjacent the second opening. This positioning of the axis leads to a favorable leverage relationship in manipulation of the catch means.

Further, the spring means preferably comprise a hair pin spring, one limb of which rests against a foot section formed on the inner end of the bolt in the lock, and wherein the second limb abuts the catch means keeping it in a neutral position in parallel with the longitudinal axis of the catch bolt while a ledge on the catch means forms a stop surface for the foot section. In this way the spring means serves two separate functions.

Besides, the catch means may form a part of a horizontal partition wall in the lock housing. This design gives an inner protection within the lock, against manipulation of the lock bolt.

BRIEF DESCRIPTION OF THE DRAWINGS

One embodiment of the invention will now be described in more detail, with reference to the accompanying drawings, in which FIG. 1 in a broken view shows a section through a lock according to the invention, with the catch bolt in a neutral position, FIG. 2 correspondingly shows the lock with the catch bolt in its inner end position, during manipulation via the door handle, and FIG. 3 correspondingly shows the lock with the catch means in a released position, during turning of the catch bolt.

DESCRIPTION OF A PREFERRED EMBODIMENT

Figure 1:
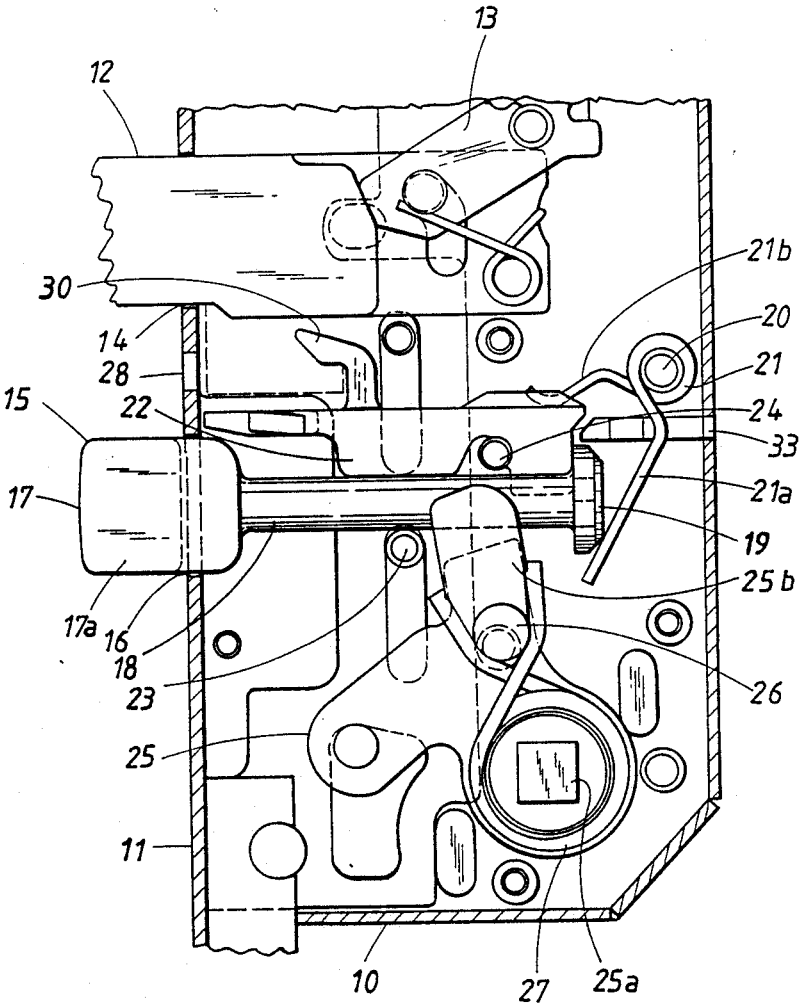

The lock shown in the drawings, comprises an insert portion 10 which reaches into a door leaf, and a front wall 11 which is recessed into the edge of the door leaf. According to the art, a locking bolt 12 is displaceably journalled in the lock housing, and it can be maneuvered by means of drivers, not shown in the drawings, via a lever 13, in and out through an opening 14 in the front wall 11.

A catch bolt 15 is displaceable in parallel with the locking bolt 12, through a second opening 16 in the front wall 11. The catch bolt 15 comprise a head 17 with one linear side **17*a* (see FIG. 1) and one bevelled side 17*b* (see FIG. 3). Besides, the catch bolt comprises a shoulder portion 18 and an enlarged foot section 19. The catch bolt is held in the neutral position shown in FIG. 1, by means of a hair pin spring 21 which is mounted on a cross pin 20 in the lock 21, said spring having one limb 21*a* abutting the foot portion 19 of the bolt. The second limb 21*b* rests against the upper side of a catch means 22, which has a vertical stop surface 22*a* cooperating with the foot portion 19 for limitation of the stroke of the bolt 15 out of the lock, past the neutral position shown in FIG. 1**.

The catch bolt is guided between two cross pins 23, 24, which define the axial path of the bolt together with the edges of the catch bolt opening 16.

Figure 2:
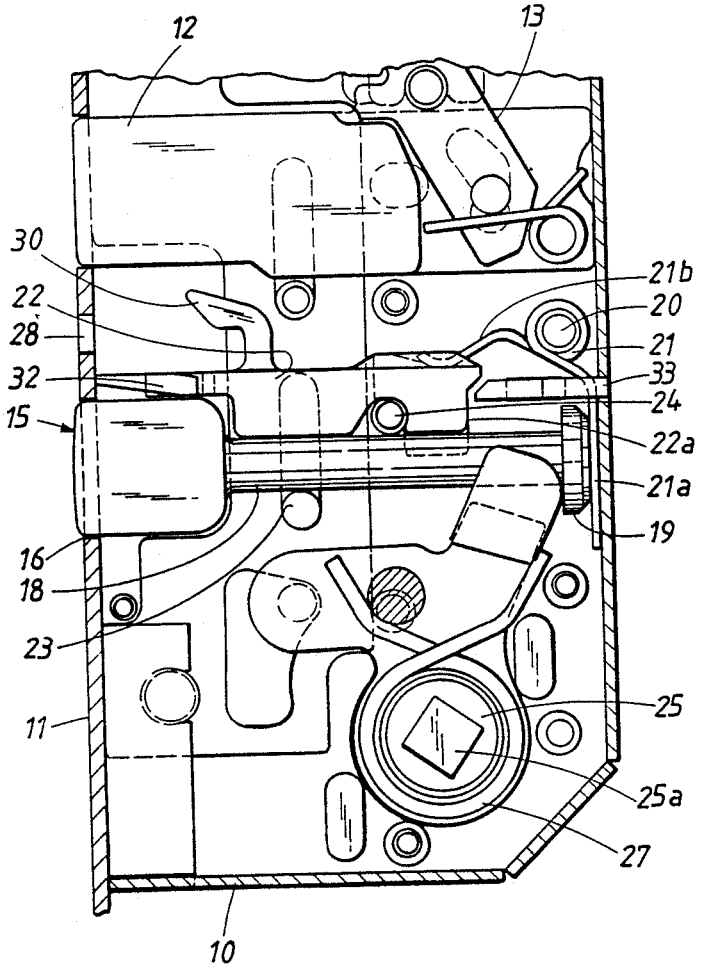

A door handle driver 25 is rotatable journalled in the lock and it can be manipulated by means of a door handle via a rectangular aperture **25*a*. A pin 26 in the lock defines the neutral position of the door handle driver 25 shown in FIG. 1, by means of a second hair pin spring 27. A driver ledge 25*b* on the door handle driver 25 is designed to act against the foot portion 19 of the catch bolt 15, so that the catch bolt will be pulled into the lock as FIG. 2** shows, when the door handle is manipulated, i.e. the door handle driver is turned clockwise in the drawings.

Figure 3:
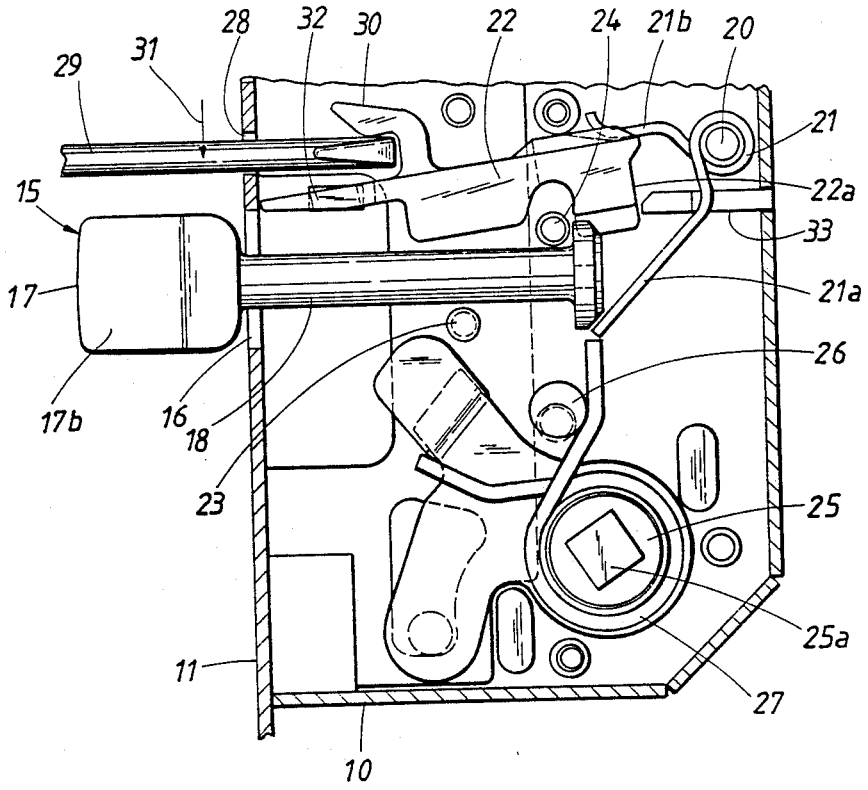

FIG. 3 shows a tool 29, e.g. a screwdriver, which has been introduced via a small opening 28 in the front wall 11. This tool 29 entered below a hook 30 which points out from the catch means 22. By forcing the tool downward in the direction of the arrow 31, the catch means may be pivoted around a pivot 32 which has an axis across the lock plane, and is situated between the hook 30 and the opening 28. During manipulation of the tool, the catch means 22 is pivoted anti-clockwise around the pivot point 32, so that its stop surface **22*a* is brought upwards, out of the way for the foot portion 19 of the catch bolt 15. The limb 21*a* of the hair pin spring 21 is now able to press the catch bolt forward, until the head 17 completely out of the opening 16. Now it is possible to turn the catch bolt 15 180° around its longitudinal axis and then slide the bolt past the stop surface of the catch means 22*a*, wherein the catch means again may snap into its catch position, by the action of the limb 21*b* of the hair pin spring 21**.

In this way it is a simple thing to turn the catch bolt, even when the lock is mounted in the door leaf. In the normal position shown in FIG. 1 and 2 the catch means 22 together with an extension portion 33, forms an horizontal partition wall in the lock, which prevents manipulation of the lock bolt from the outside, e.g. by means of a bent steel wire.

The invention is not limited to the above described embodiment, but several variations are possible within the scope of the accompanying claims. For example, the lock according to the invention may be combined with a so called security espagnolette.

What I claim:

1. A doorleaf lock, having a lock mechanism for governing a locking bolt and a catch bolt, which is controllable by means of a door handle, said catch bolt, in a neutral position defined by a spring means, extending with a non-circular bolt head through a non-circular opening in the lock front wall, abutting a catch means, and being displaceable into the lock, against the action of said spring means, during manipulation of said handle, wherein said catch means is accessible via a second opening in the front wall, and displaceable from its catch position by manipulation from the outside via the second opening so that the catch bolt, after said manipulation of the catch means, can be displaced with its bolt head out of the non-circular opening to the outside of the lock, enabling a turning of the catch bolt around its longitudinal axis; wherein the catch means is pivotable around a pivot axis, which extends across the longitudinal axes of the bolts and the plane of the lock housing; wherein the pivot axis is placed adjacent the second opening; wherein the spring means comprises a hair pin spring, one limb of which rests against a foot section formed at the inner end of the bolt in the lock, and the second limb abuts the catch means keeping it in a neutral position in parallel with the longitudinal axis of the catch bolt while a ledge on the catch means forms a stop surface for the foot section; and wherein the catch means and an extension portion internal of the lock and constructed to cooperate with the catch means form a partition wall which is horizontally oriented when the lock is in an installed position.

* * * * *